FIG 1
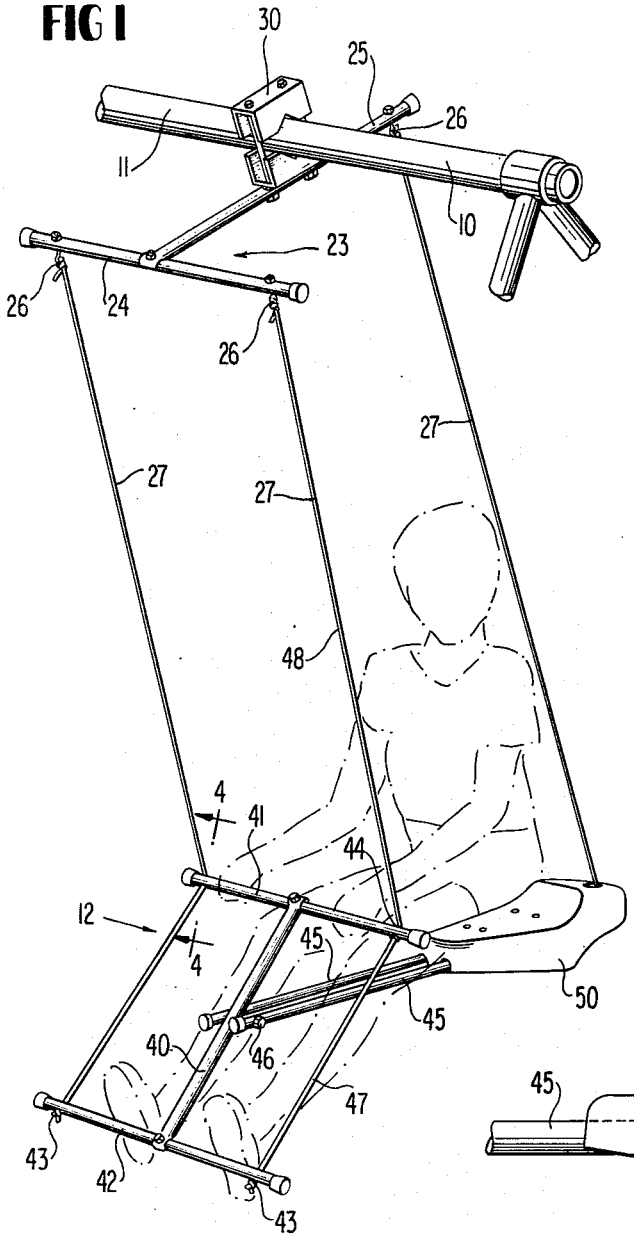
FIG 2
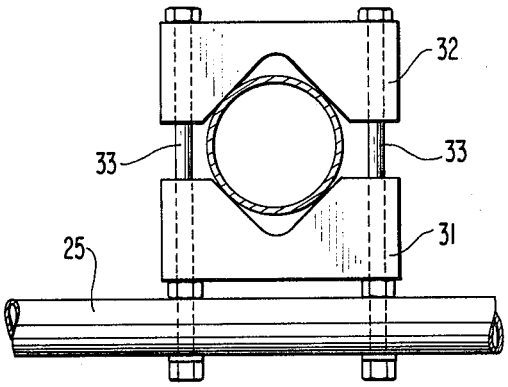
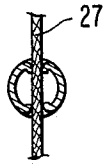
FIG 4
FIG 3
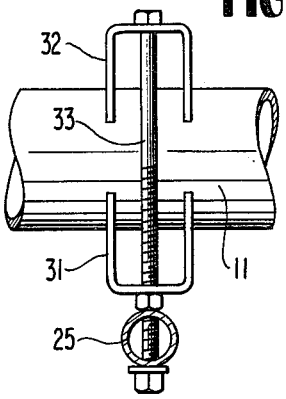
FIG 5
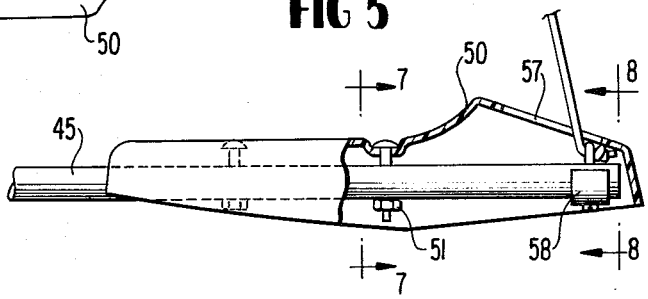
FIG 7
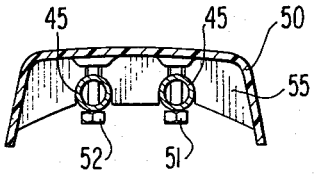
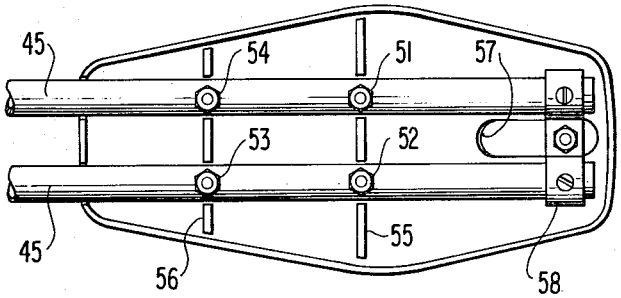
FIG 6
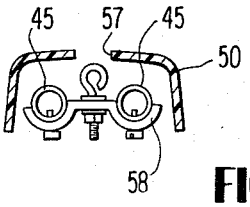
FIG 8

United States Patent [19]

Smith et al.

[11] 4,155,548

[45] May 22, 1979

[54] CHILD'S SWING

[76] Inventors: C. Fletcher Smith, 602 Thompson La., Nashville, Tenn. 37204; Herbert Piercey, Jr., 112 Castaway Ct., Nashville, Tenn. 37214

[21] Appl. No.: 893,564

[22] Filed: Apr. 5, 1978

[51] Int. Cl.[2] ..... A63G 9/00

[52] U.S. Cl. ..... 272/87; 248/317

[58] Field of Search ..... 272/85, 86, 87, 88, 272/89, 90, 91, 92; D34/5 M; 248/17, 317, 327, 361, 370, 489; 403/346, 375, 382, 400; 297/273, 274, 275, 276, 277, 278, 279, 280, 281, 282; 211/113

[56] References Cited

U.S. PATENT DOCUMENTS

| | | | |
|---|---|---|---|
| 323,709 | 8/1885 | McMullen | 272/92 |
| 1,575,829 | 3/1926 | Hambidge | 272/87 |
| 1,674,899 | 6/1928 | Haberman | 272/90 |
| 2,464,446 | 3/1949 | Helms | 272/87 |
| 2,699,201 | 1/1955 | Levy | 272/87 |
| 3,503,582 | 3/1970 | Boucher | 272/87 |

FOREIGN PATENT DOCUMENTS

| | | | |
|---|---|---|---|
| 629091 | 11/1959 | Canada | 272/87 |

*Primary Examiner*—Richard C. Pinkham
*Assistant Examiner*—T. Brown
*Attorney, Agent, or Firm*—Sughrue, Rothwell, Mion, Zinn and Macpeak

[57] ABSTRACT

A child's swing set of the type which is pumped by both hand and foot action on horizontal bars and includes a "T"-shaped upper support bracket capable of mounting on a horizontal bar for the purpose of providing three-point suspension of the swing set below. A swing set seat and support arrangment includes horizontal set support members which carry the weight and stress of the swing member, and a molded plastic seat for comfort of the swinger, but which does not carry the direct loads of the swing assembly.

5 Claims, 8 Drawing Figures

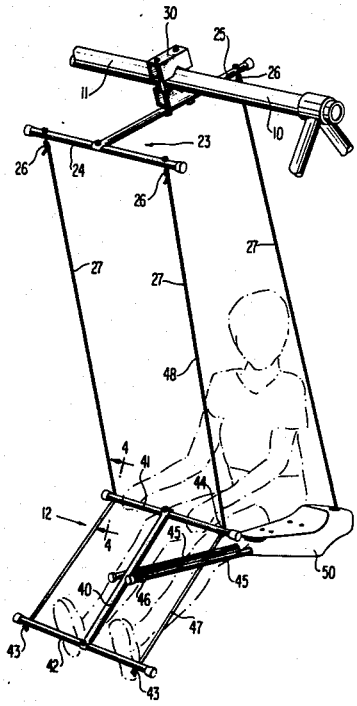

CHILD'S SWING

BACKGROUND OF THE INVENTION

This invention relates to children's swings in which the swinging is effected by both the hands and feet of the swinger. The swings generally are suspended from a point which is substantially higher than the swing, or they are suspended from three fixed points which are located relatively close to the point of attachment of the swing.

U.S. Pat. No. 1,575,829, Hambidge, shows a swing of this general type which is secured to flexible connections which extend from well above the swing. However, this swing does not provide any bracket or clamp means by which the swing may be secured to a low horizontal bar.

Similarly, U.S. Pat. Nos. 2,464,446, Helms, and 2,059,777, Denney, again depict swings of this general type, but fail to show a mounting on a low horizontal bar. Further, the Helms patent requires that the three separate ropes each be secured to the three separate points located in a ceiling.

Still further, that art known to applicants, the seat material itself is used to form the pivotal connection with the vertical upright member. In each of these prior art devices, the seat material is depicted to be either wood or a sheet metal which has a single tongue which engages the vertical support members.

SUMMARY OF THE INVENTION

This invention relates to an improved bracket and clamp portion of a child's swing of the type providing for both hand and foot pumping. By this bracket, the swing may be attached to a single horizontal bar. Such horizontal bars are now generally used in swing sets and are generally constructed of tubular steel. These swing set supports are widely distributed as backyard play equipment today. Further, these horizontal bars are also located relatively close to the ground.

By this invention, a "T"-shaped bracket may be fixed to the horizontal bar of a common swing set, and it will provide the three points spaced apart which are required for the ropes from this hand and foot pumping type of swing. The swing ropes are attached to each of the three points provided by the "T"-shaped member. The clamp means is secured to the horizontal bar and to a point on the "T"-shaped bracket which is near the balance point which is defined when a child is in the swing below.

Still further, this invention utilizes two parallel seat support bars which are separated from each other by a single upright member which is pivotally connected at one end of the support bars. By this construction, it is only necessary to utilize a single, simple tubular vertical support bar, for holding both the upper and lower horizontal handle and foot bars, respectively.

It is therefore an object of this invention to provide an improved child's hand and foot pumping swing which allows for convenient mounting on a swing set horizontal bar.

It is a further object of this invention to provide an improved seat and vertical bar arrangement, whereby a single vertical upright member is sufficient. This allows for a less expensive seat construction and simpler design for the swing set.

BRIEF DESCRIPTION OF THE DRAWINGS

FIG. 1 shows a complete assembly view of the entire swing set, including its mounting on a horizontal bar which is a portion of a standard backyard swing support.

FIG. 2 shows an end view of the swing set horizontal bar, the clamp which surrounds the horizontal bar, and the single overhead bar.

FIG. 3 shows a front view again of the horizontal bar and clamp means with the overhead bar.

FIG. 4 shows a detailed view of the rope as it passes through the first horizontal handle bar.

FIG. 5 shows a detailed view of the bolts which secure the molded plastic seat to the horizontal seat support and the connection for the third rope.

FIG. 6 shows a top view of the seat as depicted in FIG. 5.

FIG. 7 shows a cross-section of the seat taken along line 7—7 of FIG. 5.

FIG. 8 shows a cross-section taken along line 8—8 of FIG. 5.

DESCRIPTION OF THE PREFERRED EMBODIMENT

Referring to the drawings, and particularly FIG. 1, a swing set 10 is shown with its horizontal bar 11. Attached to the horizontal bar is the child's hand and foot operated swing generally depicted as 12.

The swing includes a "T"-shaped bracket 23 which has a first bracket member 24 and a second bracket member 25. The first bracket member has connected to its center one end of the second bracket member 25. In this manner, the "T"-shaped overhead bracket configuration is formed. At the tip of each leg of the "T", there is located a means 26 for attachment of the three ropes 27 which extend downward to the swing.

The second bracket member 25 is attached to a clamping means 30. The clamping means 30 consists of a lower clamp bracket 31 and an upper clamp bracket 32, as depicted in FIG. 2. Extending through clamping brackets 31 and 32 are bolts 33 which extend upward and through the second bracket member 25. By this arrangement, the bolts 33 are used to secure the clamp means to the second bracket member as well as to secure the clamp means to the horizontal bar 11 of the swing set 10. FIG. 3 depicts an end view of the brackets 31 and 32 and further shows their attachment to the horizontal bar 11.

The clamp means 30 is preferably secured to the second bracket member 25 at a point which lies between its ends and is at the approximate balance point as defined with a child below.

Referring again to FIG. 1, in the lower portion, there is depicted the pumping portion of the swing. This is the portion of the swing which is manipulated by both arm and leg motion. The pumping portion of the swing includes a pivotable upright member 40 which has connected to its upper end a first horizontal bar 41 which is used as a handle. Connected to the lower portion of the upright member 40 is a second horizontal bar 42 which is used as a foot bar. It is through pushing and pulling on bars 41 and 42 that the swing is pumped by both the child's hands and feet.

Attached to the second horizontal bar or foot bar 42 are two of the ropes 27 which are secured by knots 43 or similar attachment means. In the first horizontal bar or handle bar, there is provided means for providing sliding engagement of the ropes through the first horizontal handle bar to protect against chafing. By the sliding engagement provided at 44, the rope will carry the weight of the child and the swing due to the connection at means 43. The tension in the portion 47 of the rope 27 is the same as in portion 48.

This invention also includes a seat assembly which has seat supports 45 which are pivotally connected to the upright member 40 by a bolt 46. The seat support members 45 are generally parallel and spaced apart a distance approximately equal to the diameter or width of the upright member 40.

The seat 50 is generally depicted in detail in FIGS. 5–8. The seat 50 is made of a molded plastic or of a fiberglass and resinous material. Bolts 51, 52, 53 and 54 secure the seat supports 45 to the molded seat. Further, there are provided guides 55 and 56 which maintain the position of horizontal seat supports 45 relative to the molded seat 50. There is a slot or opening 57 provided at the rear of the seat through which one of the ropes 27 may extend for attachment to the rearward end of the horizontal seat supports. This attachment may be by means of a clamp member 58. It is by the use of the horizontal seat supports that it is possible to use a relatively weak seat material 50 which is not required to take great stress due to the swinging action since the loads are taken up in the horizontal seat supports 45 and not in the seat member itself.

As can be seen generally in FIG. 1, it is necessary to have each of the three ropes 27 separated at three different locations above the location of the swing. Without the use of a bracket member 23, it would not be possible to utilize this type of hand and foot pumping child's swing in combination with a standard backyard overhead bar swing set.

Still further, the separation of the functions of the seat 50 from the seat supports 45 eliminates the subjection of the seat to substantial swinging forces, in contrast to the prior art.

The description hereinabove has been of the preferred embodiment, and it is to be understood that changes may be made in the shape, size and construction of parts without departing from the spirit of this invention.

What is claimed is:

1. In a child's swing of the type having an upright member, having a first horizontal handle bar secured to the upper end of said upright member, and a second horizontal foot bar secured to the lower end of said upright member, a horizontal seat assembly pivotally secured to said upright member intermediate the ends thereof two ropes separately secured to each end of said second horizontal foot bar and in sliding engagement with said first horizontal handle bar, whereby that portion of said rope between the second horizontal handle and the first horizontal foot bar is in tension, when said seat assembly is occupied by a rider, a third rope secured to that portion of the seat assembly which is located furthest from the point where said horizontal seat support is pivotally secured to said upright member, the improvement comprising:

an overhead bracket having first and second straight bracket members which are joined together to form a "T" shape, said first bracket member having rope attachment points at each end, said second bracket member having a rope attachment point at one end thereof and being attached at the other end thereof to said first bracket member at its center; and a clamp member secured to said second member at a point between its ends for securing the "T"-shaped bracket to a single overhead bar.

2. The child's swing as claimed in claim 1 wherein said first horizontal handle bar includes smooth pathways through its ends for providing protection from chafing or tearing of the ropes which pass through said pathways.

3. The child's swing as claimed in claim 1 wherein said seat assembly comprises a contoured seat which is secured to a horizontal seat support, wherein said contoured seat is made of a resinous material.

4. The child's swing as claimed in claim 1 wherein said seat assembly includes two parallel tubular supports which are separated by said upright member.

5. The child's swing as claimed in claim 1 wherein said clamp is secured to said "T"-shaped bracket member and to a single overhead support bar by two bolts which pass through said second support member and through said clamping means.

* * * * *